US005286062A

United States Patent [19]

Greenwood et al.

[11] Patent Number: 5,286,062

[45] Date of Patent: Feb. 15, 1994

[54] SPECIALTY GAME TICKETS

[75] Inventors: W. Loren Greenwood, Woodinville; Harry Poll, Edmonds, both of Wash.

[73] Assignees: Ace Novelty Co., Inc., Bellevue; Trade Products, Incorporated, Linnwood, both of Wash.

[21] Appl. No.: 612,827

[22] Filed: Nov. 13, 1990

[51] Int. Cl.[5] ..... B42D 15/00

[52] U.S. Cl. ..... 283/106; 281/2; 281/5; 283/105; 283/903

[58] Field of Search ..... 281/2, 5; 283/105, 106, 283/903

[56] References Cited

U.S. PATENT DOCUMENTS

| | | | |
|---|---|---|---|
| 426,849 | 4/1890 | O'Beirne et al. . | |
| 3,512,780 | 5/1970 | Allison | 273/139 |
| 3,900,219 | 8/1975 | D'Amato et al. | 283/903 |
| 4,033,611 | 7/1977 | Johnsen | 283/903 |
| 4,074,911 | 2/1978 | Stipek, Jr. | 283/903 |
| 4,099,721 | 7/1978 | Logander | 283/903 |
| 4,128,954 | 12/1978 | White | 40/310 |
| 4,174,857 | 11/1979 | Koza | 283/903 |
| 4,428,526 | 1/1984 | Riley | 229/92.8 |
| 4,551,373 | 11/1985 | Conlon | 283/903 |
| 4,583,763 | 4/1986 | Shacklett, Jr. | 281/5 |
| 4,603,884 | 8/1986 | Burton | 283/903 |
| 4,699,833 | 10/1987 | Instance | 283/105 X |
| 4,703,933 | 11/1987 | Cahill et al. | 283/105 X |
| 4,726,608 | 2/1988 | Walton | 283/96 |
| 4,726,972 | 2/1988 | Instance | 428/40 |
| 4,768,810 | 9/1988 | Mertens | 282/12 A |
| 4,778,153 | 10/1988 | Bachman | 283/101 |

FOREIGN PATENT DOCUMENTS

| | | | |
|---|---|---|---|
| 950508 | 10/1956 | Fed. Rep. of Germany | 283/903 |
| 2216583 | 10/1973 | Fed. Rep. of Germany | 283/903 |
| 1185060 | 3/1970 | United Kingdom | 283/903 |
| 1540639 | 2/1979 | United Kingdom . | |
| 2009673 | 6/1979 | United Kingdom | 283/903 |
| 2085308 | 4/1982 | United Kingdom | 283/903 |
| 2183203 | 6/1987 | United Kingdom . | |

OTHER PUBLICATIONS

Bingo Ticket; Irish Ticket.
Blockbuster Video Ticket (3 sheets).

*Primary Examiner*—Paul A. Bell
*Attorney, Agent, or Firm*—Jones, Day, Reavis & Pogue

[57] ABSTRACT

An improved gaming ticket having a first portion and a second portion, the second portion having folded sections forming three thicknesses containing hidden indicia. The three thicknesses are glued together along only the outer edges thereof. Perforations are placed only in the top two sections on the inside of the glue areas such that by tearing the top two sections along the perforations, the ticket sections can be separated to view the hidden indicia.

12 Claims, 2 Drawing Sheets

SPECIALTY GAME TICKETS

FIELD OF THE INVENTION

The present invention relates to specialty tickets of the paper type and in particular to a specialty ticket having a first panel with visible indicia on a first portion identifying the ticket and having a second adjacent area and a second panel formed with two folded sections concealing indicia that represent winning or nonwinning combinations and perforation extending along the side edges of only the two folded sections to allow them to be easily separated for viewing the concealed combination of indicia. Glue or adhesive is used in the area between the perforations and the side edges of the folded sections to hold the folded sections together. Further, an opaque color is formed upon at least one side of one or more panels to prevent the concealed indicia from becoming visible to the naked eye upon "candling" with high-powered light sources.

BACKGROUND OF THE INVENTION

Games of chance are becoming increasingly a part of industry and commerce. Such games of chance include specialty tickets of the paper type which have first and second sections, a first section of which identifies the ticket and a second section which contains a hidden combination of indicia representing winning and nonwinning combinations.

In one such type of ticket, the portion containing the concealed indicia comprises a plurality of folded sections on the inside of which is printed the combination of indicia. Once the sections are folded, a strip of thin colored paper is wrapped over the outside of the folded sections and the ends of the paper are glued together to hold the sections in the folded condition. The colored paper also serves to prevent the concealed indicia from becoming visible upon "candling" with a high-power light source. When the purchaser desires to open the ticket he simply tears the thin paper wrapping and opens the folds.

In another type of specialty ticket, one or more combinations of indicia may be placed on a first card with a second card placed over and covering the surface of the first card. The two cards are attached in some manner such as by glue placed at the edges. Over each combination of indicia is a rectangular cover section in the second card that has perforated edges around at least three sides thereof which can be torn loose and the rectangular cover section lifted to view the indicia thereunder.

Because these specialty tickets are becoming so numerous, it is important that they be made as economically as possible and as simply as possible and still ensure that the concealed indicia cannot be seen through the paper without the ticket being opened. In the prior art specialty tickets, it is expensive and time-consuming to either place a colored paper band around the folded portion of the ticket and glue the ends thereof or to place a top card over the indicia printed on a bottom card and place perforations in the top card to form an area superimposed on and surrounding the indicia on the bottom card so that the perforated area of the top card can be torn loose to expose the concealed indicia.

In partially commonly assigned co-pending application Ser. No. 07/477,675 filed Feb. 9, 1990 for "Specialty Game Cards and Method and Apparatus for Making Same", a specialty ticket is disclosed that has a first panel with identifying indicia and a second panel formed with folded sections that conceal winning or nonwinning combinations of indicia. The sections are securely held by crimped perforations extending along and through the side edges of only the folded sections forming the second panel. These crimped perforations hold the folded sections securely together yet allow them to be easily separated so that the combination of indicia concealed on the inside of these sections may be exposed. However, the perforations must be formed after the ticket has been folded and glued. This process is somewhat complicated by reason of the requirement to form the perforations through the folded portion of the ticket after it has been folded and glued.

The present invention overcomes this disadvantage by providing a specialty ticket that can be made in a much more simple and economical manner. The ticket has a first panel with identifying indicia and a second panel integrally formed with the first panel and formed of two folded sections which, when folded over at least an area of the first panel, forms at least three thickness concealing indicia representing winning or nonwinning combinations on the inside of the folded sections. Adhesive holds only the outer side edges of the folded sections securely together. Perforations extend inwardly of the adhesive and along the outer side edges of only the two folded sections forming the second panel to allow the two folded sections to be torn along the perforations to expose the indicia hidden on the inside thereof. With this construction, the perforations extending inwardly of the adhesive and along the outer side edges of only the two folded sections forming the second panel can be placed in the tickets after the printing but prior to the folding and gluing and, thus, enable a simpler process to be used to construct the ticket that is more economical. The folded sections also have an opaque color on at least one side of one or more of them to prevent the concealed indicia from being viewed through the folded sections. Further, if desired, the entire first and second panels, both sides, may be a solid opaque color with contrasting colored indicia printed thereon. This embodiment is included in the use of the term "opaque section" herein. In addition, a glue dot may placed between the bottom one of the folded sections and the adjacent folded area to assist in preventing unwanted separation of the folded sections.

A method is disclosed in which the elongated tickets in the unfolded state are first printed with the desired indicia and have opaque colors added on at least one side of one or more sections to prevent the concealed indicia from being revealed with a powerful light when the sections are folded. The ticket is then perforated inwardly and along the outer side edges where the top two folded sections will be formed. Then the ticket is taken to a device well known in the art for placing the glue in the desired areas between the outer edge of the ticket and the perforations. Finally, the tickets are folded to their final state.

Thus, it is an object of the invention to provide a game ticket that is more easily and economically formed.

It is also an object of the present invention to provide perforations in the ticket in its unfolded state in desired areas that enable the ticket to have a portion removed along the perforations to view the concealed indicia.

It is still a further object of the present invention to provide a ticket which has a first panel with the visible indicia on a first area thereon and having a second adjacent area and a second panel integrally formed with the first panel and having folded sections that can be folded over the second area to form at least three thicknesses with indicia thereon representing winning or nonwinning combinations and having perforations extending inwardly of adhesive placed only on the outer side edges of the folded sections such that when the sections are folded over the second area, only the two sections can be torn along the perforations to expose the indicia hidden on the inside thereof.

SUMMARY OF THE INVENTION

The present invention is an improvement in specialty tickets of the paper type having a first panel with visible indicia in a first area and having a second adjacent area, a second panel integrally formed with the first panel and formed of at least two sections that can be folded together and over the second area to form at least three thicknesses with indicia representing winning or nonwinning combinations hidden by the folded sections, adhesive holding only the outer side edges of the three folded thicknesses securely together, and perforations extending inwardly of the adhesive and along the outer side edges of only the at least two folded sections to allow the at least two folded sections to be torn along the perforations to expose the indicia hidden on the inside thereof.

The invention also relates to a method of forming an improved gaming ticket comprising the steps of forming a ticket of elongated, rectangular shape; printing indicia on the ticket as desired, including indicia representing winning and nonwinning combinations and applying opaque colors in predetermined areas of the ticket; forming perforations a predetermined distance along and inwardly from the ticket outer edges; depositing adhesive on the ticket in areas only between the perforations and the side edges of the ticket; and folding the ticket to form a part thereof having three folded sections such that the indicia representing the winning and nonwinning combinations are hidden by the folded sections, covered by at least one opaque colored area, and exposed to view when the top two folded sections are torn along the perforations.

BRIEF DESCRIPTION OF THE DRAWINGS

These and other objects of the present invention will be more easily and readily understood by one skilled in the art by reference to the following detailed description taken in conjunction with the accompanying drawings in which like numerals represent like elements and in which.

DETAILED DESCRIPTION OF THE DRAWINGS

Figure 1:
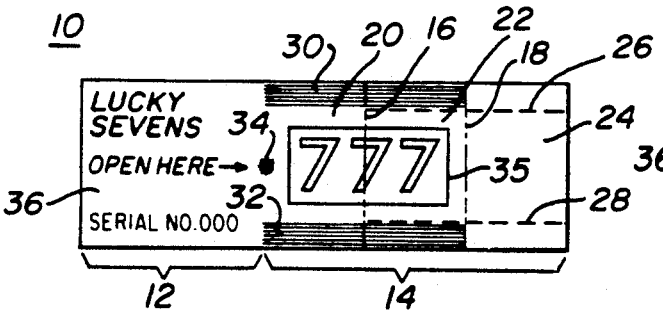
FIG. 1 is a top view of the novel improved specialty ticket in its unfolded condition.

The novel, improved gaming ticket 10 is illustrated in its unfolded state in FIG. 1 and has a first panel 12 having visible indicia 36 in a first area and a second adjacent area 20 where indicia is shown. A second panel 14 is integrally formed with the first panel 12 and separated by fold line 16 from first panel 12 and is formed of sections 22 and 24. Fold line 18 separates sections 22 and 24. Indicia 35 extends partially across first and second panels 12 and 14 and is to be hidden when the sections 22 and 24 are folded over each other and over area 20 to form a three thickness panel. Adhesive in areas 30 and 32 holds only the outer side edges of the sections 22 and 24 and area 20 securely together. The adhesive could extend on to section 24 if desired. Perforations 26 and 28 extend inwardly of the adhesive area 30 and 32 and along the outer side edges of only the sections 22 and 24. A glue dot 34 may be placed in the second area 20 as shown such that when sections 22 and 24 are folded over each other and over area 20 to form three thicknesses, the glue dot 34 is between the bottom one of the folded sections 22 and 24 and the second adjacent area 20 to assist in preventing unwanted separation of the folded sections.

Figure 2:
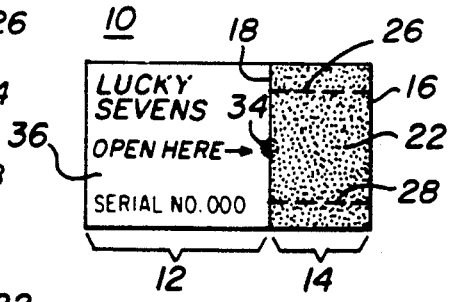
FIG. 2 is a top view of the novel improved specialty ticket in its folded condition; 7

FIG. 2 illustrates the novel ticket 10 in its folded condition. Second panel 14 now consists of two folded sections 22 and 24 which are folded over second area 20 to form three thicknesses with the indicia 35 representing winning or nonwinning combinations hidden on the inside. The glue strips 30 and 32 hold the three surfaces in their folded state. The glue dot 34 prevents anyone from lifting up the edge 18 shown in FIG. 2 to view the hidden indicia thereunder.

Figure 3:
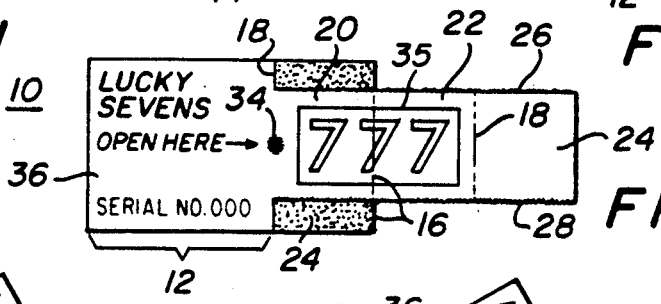
FIG. 3 is a top view of the folded novelty ticket shown in FIG. 2 after the top two sections have been removed along the perforations to expose the hidden indicia thereunder.

FIG. 3 illustrates the novel ticket in its used state. The user has grasped the edge 18 in FIG. 2 at glue dot 34 and lifted it up, thus tearing sections 22 and 24 along tear lines 26 and 28 to expose the hidden indicia 35.

Clearly, section 24 in FIG. 1 could be omitted and only section 22 folded over area 20 could have adhesive thereon and be folded over each other with perforations existing only along the edges of section 22. Section 22 could then be torn from glue dot 34 about perforations 26 and 28 to expose the indicia thereunder. However, with only two sections used there would be a greater opportunity to see the hidden indicia by candling. Thus with the use of three folded thicknesses, the advantages are greater. For instance, with the use of three thicknesses as shown, hidden indicia may be printed on the sections 22 and 24 instead of area 20 and section 22 as shown.

Figure 4:
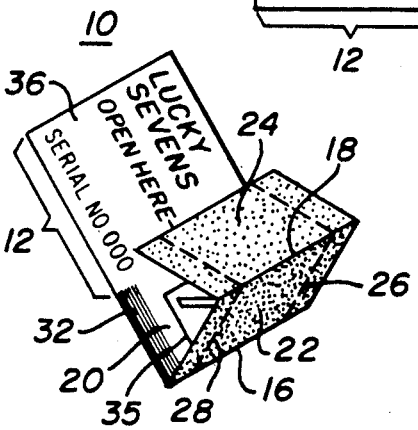
FIG. 4 is a folding diagram of the preferred embodiment of the improved ticket.

FIG. 4 is an isometric view of the novel ticket 10 illustrating the preferred manner of folding the ticket. As can be seen in FIG. 4, outer section 24 is folded inwardly about fold line 18 to cover section 22. The combined sections 22 and 24 are then folded about fold line 16 over second area 20 to cover the indicia 35 that are on second area 20. The adhesive on the edges of section 22 holds the sections 22 and 24 together and the adhesive on the edges of second area 20 holds the combined sections 22 and 24 securely to second area 20. An opaque surface of any dark color such as, for example only, blue or red may be placed on the outside or back of either second area 20 or section 22 or 24 as shown in FIG. 4, or on the inside of section 24 (not shown). Opaque colors may be placed on any panel surface when indicia is not printed. As stated earlier, the entire ticket may be of one opaque color with indicia of a contrasting color imprinted thereon. In this manner the hidden indicia are protected from being viewed with a high-powered light.

Figure 5:
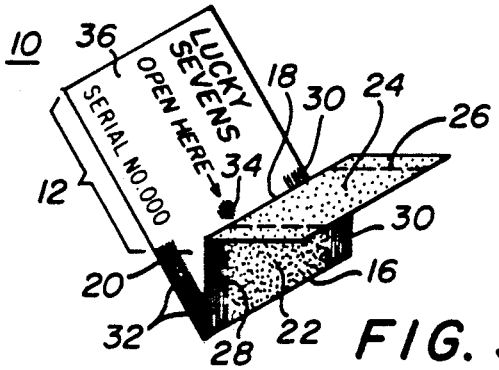
FIG. 5 is a folding diagram of an alternate embodiment of the novel ticket.

FIG. 5 illustrates an alternate method of folding the novel ticket. In this case, the outer section 24 is folded outwardly about fold line 18 over section 22. The adhesive strips 30 and 32 on the underside of section 22 (or section 24) securely bond sections 24 and 22 together. The combination is then folded inwardly about fold line 16 to cover second area 20. The adhesive on second area 20 securely bonds the combined sections 22 and 24 to second area 20. The glue dot 34, as illustrated in FIG. 2, prevents a person from lifting up the edge 18 and viewing a portion of the hidden indicia.

Figure 6:
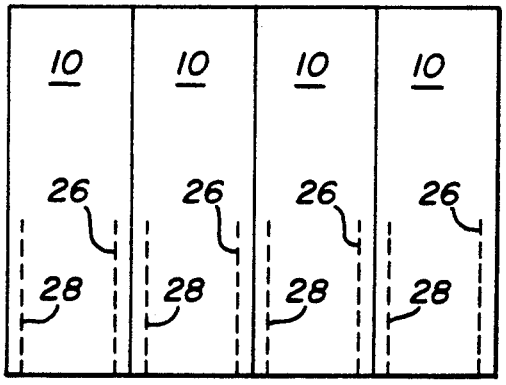
FIG. 6 is a plan view of a plurality of the ticket forms as they are being simultaneously manufactured illustrating the perforations placed in the ticket prior to the printing, gluing and folding thereof.
Figure 7:
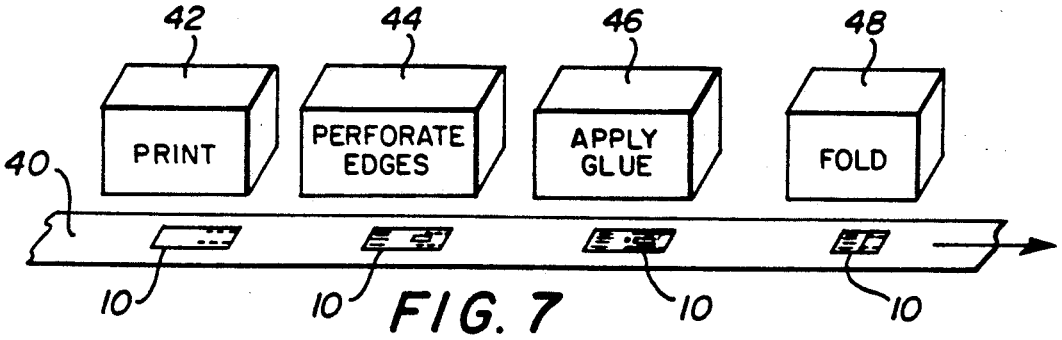
FIG. 7 is a flow diagram illustrating the method of the present invention for forming the improved ticket.

FIG. 6 is a top view of the tickets made in groups of four during the manufacturing process. Obviously, more or less of the tickets could be handled simultaneously depending upon the processing machine. As shown in FIG. 6, each of the tickets 10 is approximately one inch wide and three inches long. The perforations 26 and 28 extend approximately one and a quarter inch inwardly from one end of the ticket towards the other. The perforations 26 and 28 are placed inwardly from the outer edges of the tickets approximately one-eighth inch. The tickets are preformed as illustrated in FIG. 6 except without the perforation and are then printed with the desired indicia at step 42 as shown in FIG. 7. Desired sections also could be printed with a dark opaque ink as discussed previously to prevent viewing of the hidden indicia when the ticket is folded. The edges are then perforated at step 44 in the manner as shown in FIG. 6. Although only one ticket 10 is illustrated on the process 40 moving from left to right in FIG. 7, this is for ease of illustration and other numbers of tickets such as the four shown in FIG. 6 could be simultaneously processed. At step 46, the adhesive is applied in the proper locations. At step 48, the ticket is folded and completed and is ready for marketing. It should be noted that the process shown in FIG. 7 is only for ease of explanation and illustration. The various machines used for the different steps may be separate from each other and the tickets taken from one machine to the other rather than following a continuous process path.

Figure 8:
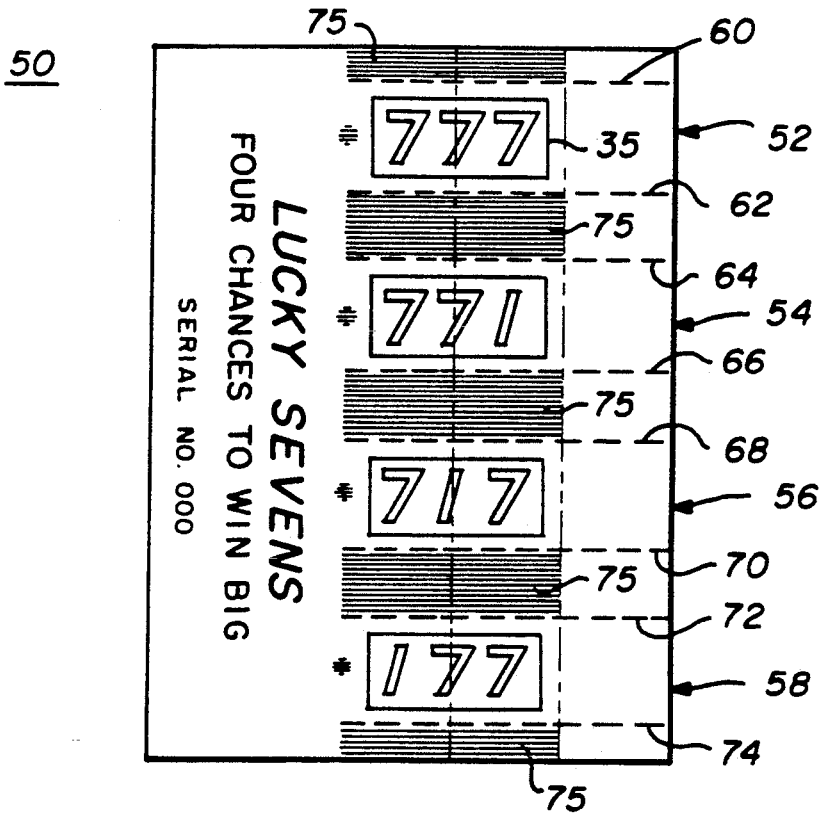
FIG. 8 is an example of an embodiment of the ticket of the present invention having multiple windows formed thereon.
Figure 9:
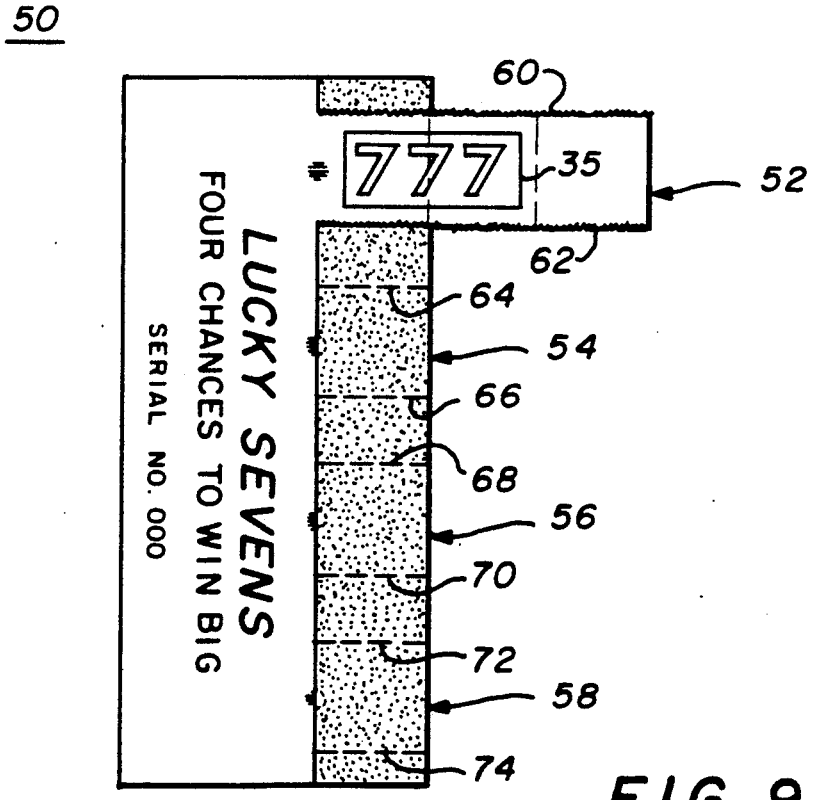
FIG. 9 illustrates the ticket of FIG. 8 in its folded condition with one window being opened to expose the hidden indicia.

Instead of separating a paper blank into four tickets as shown in FIG. 6, a single ticket may be formed having multiple windows to expose hidden indicia as shown in FIG. 8 and FIG. 9. Adhesive may be placed in shaded areas 75 as shown in FIG. 8 and the ticket folded as shown in FIG. 9 in the same manner discussed in relation to folding the ticket of FIGS. 1–5. Thus, for example only, ticket 50 shown in FIG. 8 and FIG. 9 has four windows 52, 54, 56 and 58 for concealing indicia. Window 52 is shown opened in FIG. 9 by tearing along perforations 60 and 62 to expose the hidden indicia 35. The other windows 54, 56 and 58 are shown unopened in FIG. 9. Window 54 may be torn along perforations 64 and 66 to expose the indicia hidden thereunder. Also window 56 may be torn along perforations 68 and 70 and window 58 may be torn along perforations 72 and 74 to expose the hidden indicia thereunder. Thus a ticket having multiple windows is obtained. While a ticket with four windows is shown, clearly a ticket with two or more windows can be formed as desired.

Thus, there has been disclosed a novel improved specialty ticket of the type which has a first panel with visible indicia on a first area to identify the ticket and having a second adjacent area and a second panel formed with folded sections concealing indicia that represent winning or nonwinning combinations. The folded portion of the ticket is held in its folded state by the use of adhesive on the outer edges of the folds as necessary. Perforations are formed inwardly of the adhesive and extend parallel to the outer edges of the ticket over a predetermined length, such that when the ticket is in its folded state, the second panel is formed preferably of two sections which, when folded over each other and over the second area, form three thicknesses although two thicknesses or more than three thicknesses could be used. In the preferred embodiment, when the outer two thicknesses are grasped and torn along the perforations, the ticket's torn portion unfolds to expose the indicia hidden thereunder. Because the perforations may be placed on the ticket after printing and prior to folding and gluing, the process is simplified and the ticket is produced more economically.

While the invention has been shown and described with respect to a particular embodiment thereof, this is for the purpose of illustration rather than limitation; other variations and modifications of the specific embodiment herein shown and described will be apparent to those skilled in the art all within the intended spirit and scope of the invention. Accordingly, the patent is not to be limited in scope and effect to the specific embodiment shown and described nor in any other way that is inconsistent with the extent to which the progress in the art has been advanced by the invention.

We claim:

1. A gaming ticket comprising:

a first panel having visible indicia on a first portion thereof;

a second panel integrally formed with the first panel and formed of at least two sections to be folded over and glued to a second portion of said first panel to form a three section thickness hiving indicia representing winning or nonwinning combinations hidden on the inside thereof;

adhesive holding only the outer side edges of the ticket section securely together; and perforations extending inwardly of the adhesive and along the outer side edges of only the at least one section to allow the at least one section to be torn along the perforations to expose the indicia hidden on the inside thereof.

2. A gaming ticket as in claim 1 further comprising a glue dot placed between the outer end of the at least one section and the second portion of said first panel over which said one section is folded to assist in preventing unwanted separation of the folded ticket section.

3. A gaming ticket as in claim 2 further comprising:

a first fold line separating the bottom one of the three sections and the middle one of the three sections; and a second fold line separating the top one of the three sections from the middle one of the three sections such that the top one of the sections may be folded about the second fold line over the middle one of the three sections and the combination folded about the first fold line over the bottom one of the three sections to form the three thickness ticket section.

4. A gaming ticket as in claim 3 wherein:

the top one of the three sections is folded inwardly about the second fold line and glued to the edges of the middle one of the sections beyond the perforations to form a double thickness panel that conceals at least a part of the indicia to be hidden; and the double thickness panel is folded inwardly about the first fold line and glued on the edges beyond the perforations to the bottom section of the folded ticket sections to form said three section thickness, the top two sections being easily torn free along the perforations to expose the hidden indicia.

5. A gaming ticket as in claim 4 wherein the indicia to be hidden are printed on the inside of the top two sections such that the indicia are hidden when the top two sections are folded over each other.

6. A gaming ticket as in claim 4 where the indicia to be hidden are printed on the inside of the bottom two sections such that the indicia are hidden when the top two sections are folded over the bottom section.

7. A gaming ticket as in claim 5 or 6 further comprising an opaque surface formed on at least one of at least one of the folded sections to prevent viewing of the concealed indicia through the ticket in its folded condition.

8. An improved gaming ticket of the paper type having at least a first panel with visible indicia in a first area to identify the ticket and having a second adjacent area and a second panel separated from the first panel by a first fold line, a combination of indicia that represents winning and nonwinning combinations extending across at least one of said second area of said first panel and said second panel, said second panel being formed of sections folded inwardly concealing said combination of indicia, the improvement comprising:

a second fold line separating the second panel into third and fourth sections;

perforations extending inwardly of and along the side edges of only the third and fourth sections; and adhesive applied to the outer edges of only the second adjacent area of the first panel and at least one of the third and fourth sections beyond the perforations such that when the fourth section is folded over the third section to form a double thickness portion, the fourth section adheres to the third section and when the double thickness portion is folded over the second adjacent area of the first panel, the double thickness portion adheres to the second adjacent area of the first panel, the perforations enabling the centers of the third and fourth sections to be removed up to the first fold line to expose the concealed indicia on the inside thereof.

9. A gaming ticket comprising:

a first panel having visible indicia on a first portion thereof, and having a second adjacent portion;

a second panel integrally formed with and separated from the second adjacent portion of the first panel by a first fold line;

multiple individual areas extending across said second adjacent portion of the first panel and said second panel, said individual areas having indicia at least partially thereon representing winning and nonwinning combinations;

said second panel being formed of at least two section to be folded over each other and said second adjacent portion of said first panel to form a three-section thickness that covers the winning and nonwinning combination of indicia in said individual areas;

adhesive holding said two sections to said second adjacent portion of said first section only on each side of each individual area having said indicia combinations thereon; and perforations extending from one end of the ticket inwardly of the adhesive and along each side of each individual area across only said at least two sections such that each individual indicia combination area can be separately exposed by removing a selected second panel by tearing along the perforations on each side thereof.

10. A gaming ticket comprising:

a first panel having visible indicia printed thereon;

a second panel integrally formed with the first panel and having multiple removable windows thereon for selectively exposing indicia hidden thereunder representing winning and nonwinning combinations;

each of said windows being formed of at least one top section folded over a bottom section and having the indicia representing the winning or nonwinning combinations hidden on the inside of the folded sections;

adhesive securing together only the side edges of the folded section forming each window; and perforations in only the at least one top section extending inwardly of the adhesive and along the edge of each window to allow the at least one top section of each window to be individually removed by tearing along the perforations to expose the indicia hidden on the inside thereof.

11. A gaming ticket as in claim 10 further comprising a glue dot placed between the outer end of the bottom of the at least one folded section forming each window and the adjacent bottom section to assist in preventing unwanted separation of the at least one folded section from the bottom section.

12. A gaming ticket as in claim 10 wherein said at least one top section is formed of at least two integrally formed sections folded over each other.

* * * * *